US007775378B2

(12) United States Patent
Tynes et al.

(10) Patent No.: US 7,775,378 B2
(45) Date of Patent: Aug. 17, 2010

(54) HEIGHT ADJUSTMENT MECHANISM FOR A DISHWASHER RACK AND ASSOCIATED METHOD

(75) Inventors: Ronald Gene Tynes, Wintervillle, NC (US); Christopher Edward Wheat, Winterville, NC (US); Tommy Dean Brindle, Jr., Webster City, IA (US)

(73) Assignee: Electrolux Home Products, Inc., Cleveland, OH (US)

( * ) Notice: Subject to any disclaimer, the term of this patent is extended or adjusted under 35 U.S.C. 154(b) by 423 days.

(21) Appl. No.: 11/851,833

(22) Filed: Sep. 7, 2007

(65) Prior Publication Data

US 2008/0272072 A1 Nov. 6, 2008

Related U.S. Application Data

(60) Provisional application No. 60/916,144, filed on May 4, 2007.

(51) Int. Cl.
*A47G 19/08* (2006.01)

(52) U.S. Cl. ..... 211/41.8

(58) Field of Classification Search ..... 211/41.8, 211/41.9, 207, 208, 175, 126.15, 162; 134/144, 134/163, 165, 177; 312/311, 312, 351, 334.12, 312/334.4; 248/297.21, 295.11, 299.1
See application file for complete search history.

(56) References Cited

U.S. PATENT DOCUMENTS 3,472,573 A 10/1969 Geiger
3,486,804 A 12/1969 Kaufman et al.
3,560,069 A 2/1971 Doepke
3,726,580 A 4/1973 Guth
3,726,581 A 4/1973 Doepke
3,734,589 A 5/1973 Morgan
3,736,037 A 5/1973 Doepke
3,744,646 A * 7/1973 Duncan et al. ..... 211/162
3,809,451 A * 5/1974 Pitstick ..... 312/351
3,822,085 A * 7/1974 Clark ..... 312/351
4,064,887 A * 12/1977 Geiger et al. ..... 134/144
4,097,099 A * 6/1978 Spiegel ..... 312/311
5,474,378 A * 12/1995 Smith et al. ..... 312/334.4

(Continued)

FOREIGN PATENT DOCUMENTS

CH 690488 9/2000

(Continued)

*Primary Examiner*—Jennifer E. Novosad
(74) *Attorney, Agent, or Firm*—Alston & Bird LLP

(57) ABSTRACT

A height adjustment mechanism for a dish rack of a dishwasher is provided, having an attachment channel for attaching the dish rack to the dishwasher. A wheel assembly slideably engages the attachment channel at first and second spaced apart locations. The wheel assembly includes engagement features corresponding to a plurality of dish rack heights. A rack mounting assembly is attached to the dish rack and slideably attached to the wheel assembly. A lever is pivotably engaged relative to the rack mounting assembly and is configured to selectively engage one of the engagement features. A biasing element is configured to urge the lever into selective engagement with the engagement features, and the rack mounting assembly may be moved from a first to a second dish rack height position by applying a force to the rack mounting assembly generally perpendicular to the attachment channel. An associated method and system are also provided.

9 Claims, 9 Drawing Sheets

U.S. PATENT DOCUMENTS

| | | | | |
|---|---|---|---|---|
| 5,595,200 | A | 1/1997 | Favaro | |
| 5,657,878 | A | 8/1997 | Austin | |
| 5,860,716 | A | 1/1999 | Good et al. | |
| 6,755,490 | B2 | 6/2004 | Welch et al. | |
| 6,974,040 | B2 | 12/2005 | Jahrling | |
| 7,032,604 | B2 | 4/2006 | Welch | |
| 7,168,578 | B2 | 1/2007 | Mersch et al. | |
| 7,410,228 | B2 * | 8/2008 | Dickson et al. | 312/311 |
| 2004/0103932 | A1 | 6/2004 | Kim | |
| 2005/0001524 | A1 | 1/2005 | Deiss et al. | |
| 2005/0039782 | A1 | 2/2005 | Kim | |
| 2005/0133469 | A1 | 6/2005 | Mersch et al. | |
| 2006/0119236 | A1 | 6/2006 | Dickson | |
| 2006/0237042 | A1 | 10/2006 | Weaver et al. | |

FOREIGN PATENT DOCUMENTS

| | | |
|---|---|---|
| DE | 3025311 | 1/1982 |
| DE | 4227585 | 2/1994 |
| DE | 4401259 | 7/1995 |
| DE | 19512128 | 10/1996 |
| DE | 19954471 | 5/2001 |
| EP | 33483 | 8/1981 |
| EP | 372342 | 6/1990 |
| EP | 788763 | 8/1997 |
| EP | 848930 | 6/1998 |
| EP | 901770 | 3/1999 |
| EP | 1051944 | 11/2000 |
| EP | 1136030 | 9/2001 |
| EP | 1161917 | 12/2001 |
| EP | 1166708 | 1/2002 |
| EP | 1208791 | 5/2002 |
| WO | WO0249495 | 6/2002 |
| WO | WO2006116384 | 11/2006 |

* cited by examiner

HEIGHT ADJUSTMENT MECHANISM FOR A DISHWASHER RACK AND ASSOCIATED METHOD

CROSS-REFERENCE TO RELATED APPLICATIONS

This application claims the benefit of U.S. Provisional Application No. 60/916,144, entitled Height Adjustment Mechanism for a Dishwasher Rack and Associated Method, filed May 4, 2007, which is incorporated by reference herein in its entirety.

BACKGROUND OF THE INVENTION

1. Field of the Invention

Embodiments of the present invention relate to dishwashers, and more particularly to height adjustment mechanisms for a rack within a dishwasher and methods associated therewith.

2. Description of Related Art

A typical dishwasher includes a washtub that defines a front opening, which is sealed by a door pivoting about a substantially horizontal axis. Dishware to be washed may be positioned onto an upper rack or a lower rack. These racks move horizontally from a load position where at least a portion of the rack may be positioned outside of the washtub to facilitate loading or unloading of dishware, to a washing position wherein the racks are fully within the washtub. Movement of the lower rack is typically facilitated by rollers positioned on opposing sides of the rack that engage supporting surfaces on the washtub and/or the door, when the door is in an open position. The upper rack includes wheels or rollers that engage tracks slideably connected to opposing side walls of the washtub. The wheels or rollers slide or roll within the track, which itself slides in relation to the washtub, thereby allowing the upper rack to move horizontally between a load and a washing position.

One issue that may be encountered with conventional dishwashers is that the relative vertical positioning of the upper and lower racks is fixed. In some instances, an item needing to be washed may be too large to fit between the upper and lower racks. Alternatively, items needing to be positioned on the upper rack due to temperature or other concerns may be too large to fit between the upper rack and the upper surface of the washtub. Although some have attempted to address this issue by providing mechanisms for adjusting the height of the upper rack within the washtub, the mechanisms may be complicated and/or may require multiple operations to obtain an acceptable height of the rack. Furthermore, some prior art designs can be relatively unstable. Accordingly, an improved rack height adjustment mechanism would be desirable.

BRIEF SUMMARY OF THE INVENTION

The above and other needs are met by the present invention which, in one embodiment, provides a dishwasher having a first side wall and an opposing second side wall. The dishwasher includes a dish rack adapted to support dishware in the dishwasher and a first and a second height adjustment mechanism attached to the dish rack and slideably engaged with the first side wall and the second side wall, respectively, wherein the dish rack is supported by the first and the second adjustable height mechanisms such that the dish rack is moveable in elevation relative to the dishwasher, wherein each of the first and second height adjustment mechanisms includes a wheel assembly adapted to be slideably engaged relative to the respective side wall and including a plurality of engagement features corresponding to a plurality of dish rack heights; a rack mounting assembly attached to the dish rack and slideably engaged with the wheel assembly; a lever pivotably engaged relative to the rack mounting assembly and configured to selectively engage one of the plurality of engagement features associated with the wheel assembly so as to secure the rack mounting assembly at a selected elevation relative to the wheel assembly; and a biasing element configured to urge the lever to pivot against the wheel assembly and into selective engagement with the plurality of engagement features.

Another aspect of the invention includes a height adjustment mechanism for a dish rack for use with a dishwasher having an attachment channel for attaching the dish rack relative to the dishwasher. The height adjustment mechanism includes a wheel assembly adapted to slideably engage the attachment channel at a first location and a second location spaced apart therefrom, and wherein the wheel assembly includes a plurality of engagement features corresponding to a plurality of dish rack heights; a rack mounting assembly attached to the dish rack and slideably engaged with the wheel assembly; a lever pivotably engaged relative to the rack mounting assembly and configured to selectively engage one of the plurality of engagement features associated with the wheel assembly so as to secure the rack mounting assembly at a selected elevation relative to the wheel assembly; and a biasing element configured to urge the lever to pivot against the wheel assembly and into selective engagement with the plurality of engagement features.

Another aspect of the invention includes a method for adjusting a height of a dish rack relative to an attachment channel. The method includes the steps of: providing a wheel assembly adapted to slideably engage the attachment channel at a first location and a second location spaced apart therefrom, and wherein the wheel assembly includes a plurality of engagement features corresponding to a plurality of dish rack heights wherein one of said engagement features is a peripheral edge of said wheel assembly; providing a rack mounting assembly attached to the dish rack and slideably attached to the wheel assembly; providing a lever pivotably engaged relative to the rack mounting assembly and configured to selectively engage one of the plurality of engagement features; applying a force to the dish rack generally perpendicular to the attachment channel such that the lever disengages the one of the plurality of engagement features; moving the rack until the lever engages a second one of the plurality of engagement features.

Aspects of the present invention thus provide these and other advantages, as further detailed herein.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

FIG. 1 schematically illustrates a front perspective view of a height adjustment mechanism for a dishwasher rack according to one embodiment of the present invention;

FIG. 2 schematically illustrates a rear perspective view of the embodiment of the present invention shown in FIG. 1;

DETAILED DESCRIPTION OF THE INVENTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
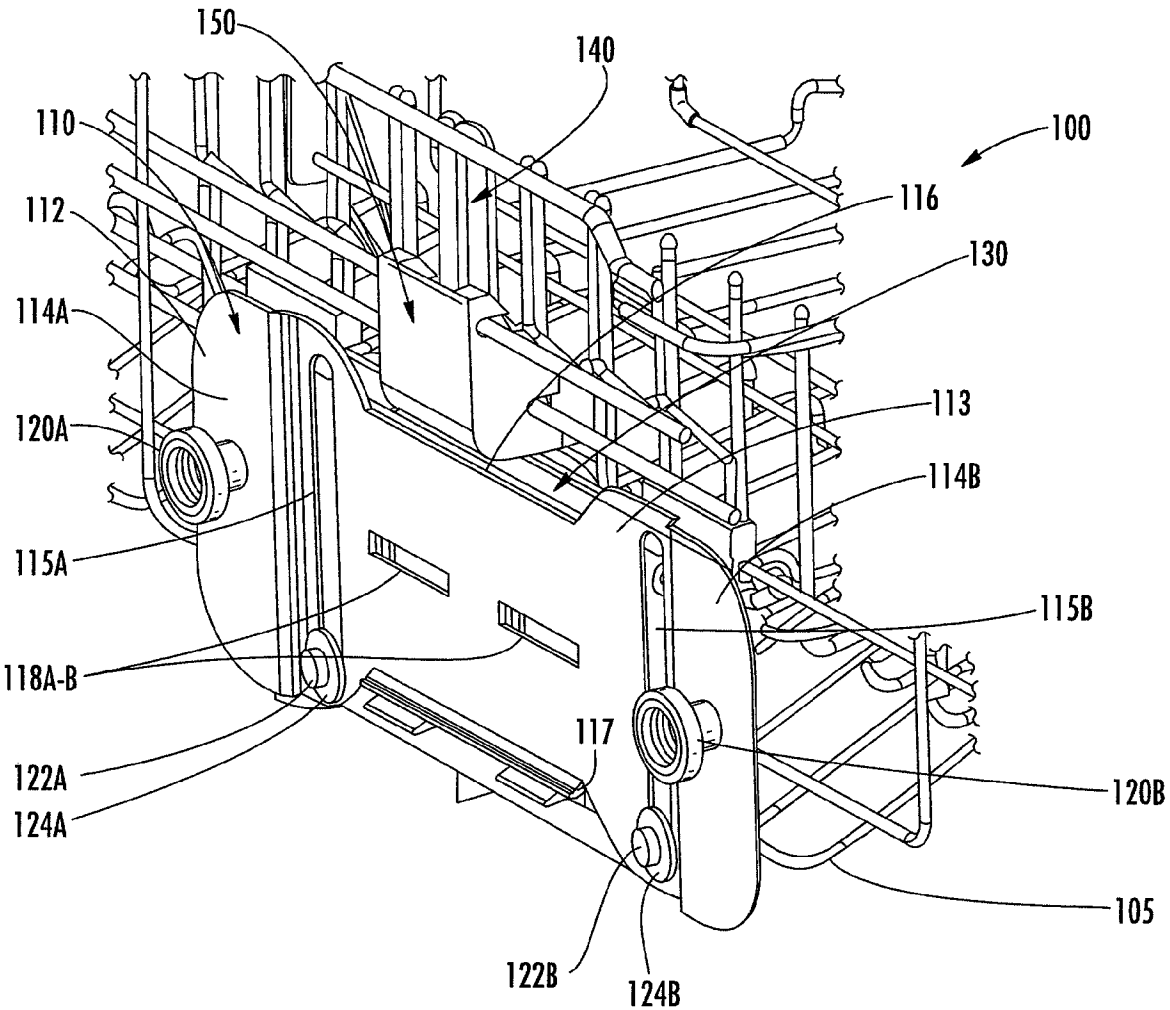
Figure 2:
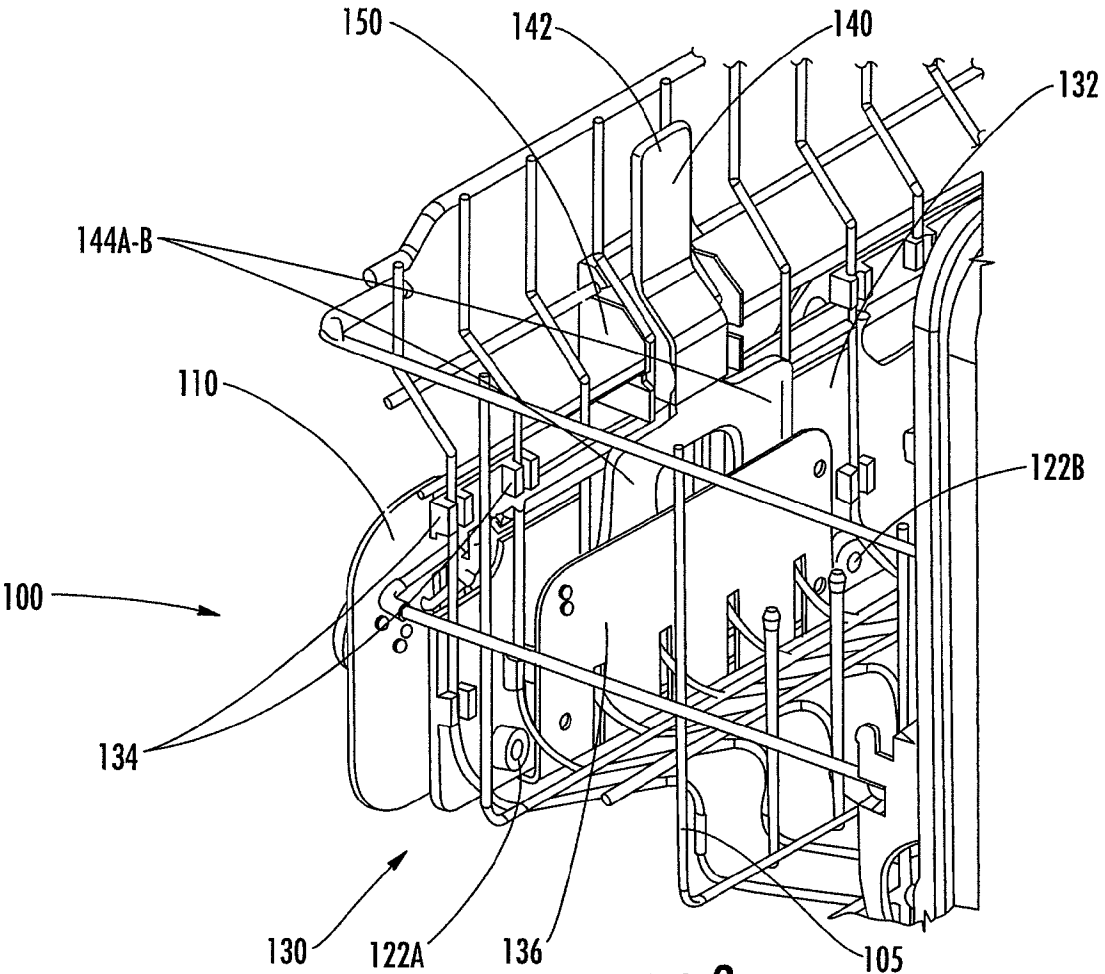

FIGS. 1 and 2 illustrate a height adjustment mechanism for a dish rack of a dishwasher according to an embodiment of the present invention, the height adjustment mechanism being generally indicated as numeral 100. Generally described, this embodiment of the present invention is intended to provide a height adjustment for a dish rack 105 of a dishwasher, wherein the rack may be an upper rack 105 or lower rack, as appropriate. As will be understood by those of skill in the art, an upper dish rack may be slideably mounted relative to the inner side-walls of a dishwasher such that the upper dish rack can move in a substantially horizontal plane from a position inside the dishwasher to a position at least partially outside the dishwasher. In one embodiment, attachment of the dish rack to the dishwasher is facilitated by a pair of C-shaped channels (see e.g., FIG. 2A). Each channel may be secured to an inner side-wall of the dishwasher by two pair of rollers, which maintain the C-shaped channel in a substantially horizontal plane while allowing the C-shaped channel to slide at least partially outside of the dishwasher.

Referring to FIG. 1, the height adjustment mechanism 100 includes a wheel assembly 110, a rack mounting assembly 130 and a lever assembly 140. Generally described, the wheel assembly 110 facilitates attachment of the height adjustment mechanism 100 to the dishwasher, and the rack mounting assembly 130 facilitates attachment of the height adjustment mechanism 100 to the dish rack 105. The lever 140 cooperates with the wheel assembly 110 and the rack mounting assembly 130 to selectively position the dish rack 105 at a desired height. The rack 105 generally includes a height adjustment mechanism 100 engaged on each lateral side thereof.

Figure 2A:
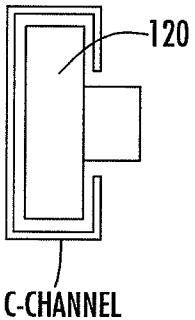

The wheel assembly 110 includes a wheel mounting plate 112 and a pair of wheels 120A-B. The wheel mounting plate 112 has a substantially planar base portion 113 and two substantially planar flange portions 114A-B positioned at opposite ends of the base portion 113. The flange portions 114A-B are within substantially the same plane, which is also substantially parallel to the planar base portion 113. Attached to each flange portion is a wheel 120A-B, which is sized to engage a mounting track (not shown) in a dishwasher. In one embodiment, the mounting track is a C-shaped channel and the wheels engage the channel as generally shown in FIG. 2A. The wheels 120A-B are aligned such that the rack will be positioned in a substantially horizontal plane. In addition, the wheels 120A-B are preferably spaced apart so as to support the rack 105 relative to the mounting track. Although the wheels shown in the figures are generally round, one of skill in the art will appreciate that other shapes may be used to engage a dishwasher mounting track.

The base portion 113 of the wheel mounting plate 112 defines two substantially parallel vertical slots 115A-B. These slots are sized to cooperate with pins 122A-B and bushings 124A-B, which provide a slideable attachment between the wheel assembly 110 and the rack mounting assembly 130. Generally described, the movement of the rack mounting assembly 130, and therefore the dish rack 105 in relation to the wheel assembly 110, is restricted by the movement of the pins 122A-B and bushings 124A-B within the slots 115A-B. In other words, movement of the rack mounting assembly 130 in relation to the wheel assembly 110 is in a direction substantially parallel with the longitudinal axis of the slots 115A-B.

The base portion 113 also defines two slots 118A-B that are spaced apart and oriented such that the longitudinal axes of the two slots 118A-B are substantially aligned. These slots 118A-B are positioned to accept a portion of the lever 140 as will be discussed in greater detail below, and are oriented generally perpendicular to slots 115A-B.

The base portion 113 further defines an upper locating edge 116 and a lower locating edge 117. In one embodiment, the lower locating edge 117 as well as the upper edges of the slots 118A-B of the base portion 113 are configured with a substantially inclined or arcuate flange. As will be discussed later, these locating edges and slots may be selectively engaged by the lever to selectively position the upper dish rack at a desired height. The locating edges and slots may be referred to herein as engagement features.

FIG. 2 illustrates the rack attachment assembly 130, which includes an outside rack mounting plate 132 and an inside rack mounting plate 136. The outside rack mounting plate 132 is positioned on the outside of the dish rack 105, while the inside rack mounting plate 136 is positioned inside the dish rack 105. These two mounting plates are secured together using fasteners (not shown) with the dish rack 105 therebetween.

In the embodiment shown in FIG. 2, the outside rack mounting plate 132 includes multiple rack attachment mechanisms 134, which are U-shaped and sized to engage a wire of the upper dish rack 105. As will be understood by those of skill in the art, the parallel walls of the U-shaped mechanisms 134 may have complementary scalloped portions such that a wire of the upper dish rack can be retained by snapping it into the scalloped portion between the parallel walls. It should be understood that other types of attachment mechanisms for connecting the outside rack mounting plate 132 to the dish rack may be used in connection with the present invention such as other snap-fit designs or fasteners.

As shown in FIGS. 1 and 2, the wheel assembly 110 and the rack mounting assembly 130 are slideably attached using pins 122A-B and bushing 124A-B. Specifically, a portion of pins 122A-B pass through bushings 124A-B and slots 115A-B in the wheel mounting plate 112 before engaging the outside rack mounting plate 132. In use, the rack mounting assembly 130 can move relative to the wheel assembly 110 in a direction substantially parallel with the longitudinal axis of the slots 115A-B.

Referring now to FIGS. 1-4, the lever 140 selectively engages engagement features of the wheel mounting plate 112 to allow a user to position the dish rack 105 at a desired height. The lever 140 includes a handle portion 142, a biasing element interface portion 143 and two engagement arm portions 144A-B. The handle portion 142 extends above the biasing element interface portion 143 with the two engagement arm portions 144A-B extending downwardly from the biasing element interface portion 143. In use, the two engagement arm portions 144A-B are positioned between the outside rack mounting plate 132 and the inside rack mounting plate 136.

Figure 3:
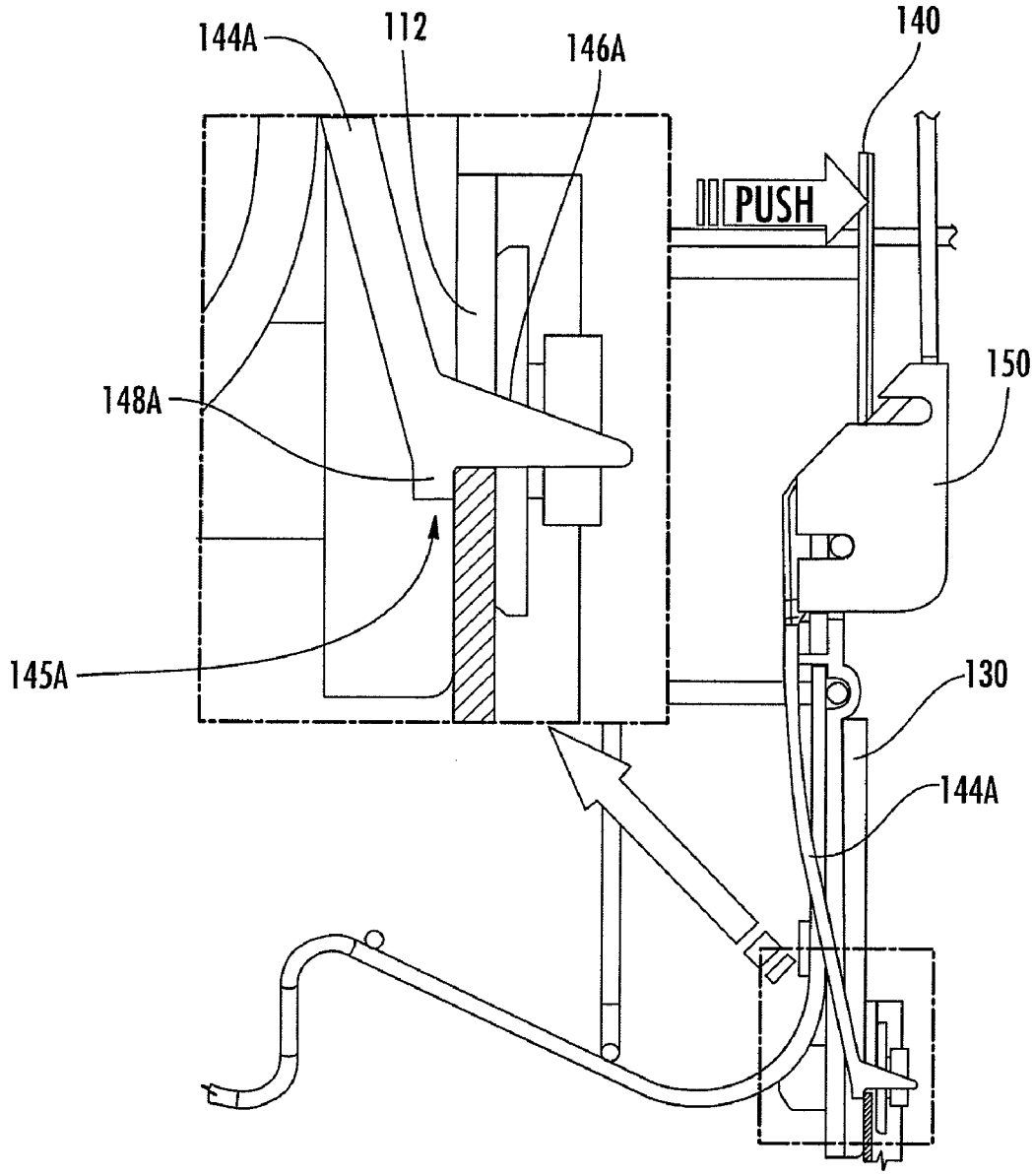
FIG. 3 is a section view of the embodiment of the present invention shown in FIG. 1 including an enlarged view of a lever engaging a mounting plate.

FIG. 3 provides a side view of an engagement arm portion 144A of the lever 140. Engagement arm portion 144A extends downwardly with a generally arcuate shape and terminates at free end 145A. The free end 145A includes a wedge portion 146A extending substantially horizontally and sized to engage the slot 118A in the wheel mounting plate 112, with the upper end of each wedge portion 146A being inclined and the lower end being substantially horizontally disposed. The free end 145A also includes a horizontal stop member 148A that discourages engagement of the wedge portion 146A with the wheel mounting plate 112 beyond a predetermined distance whether engaging the slots 118A-B or the locating edges 116, 117. The engagement arm portion 144B also extends downwardly with a generally arcuate shape terminating at free end 145B. Free end 145B also includes a wedge portion 146B, which is shaped to engage slot 118B as generally described with respect to wedge portion 146A.

The engagement arm portions 144A-B are spaced laterally apart with respect to the interaction thereof with the wheel mounting plate 112 so as to provide longitudinal stability for the rack 105 relative to the wheel mounting plate 112, alone or in combination with the pin 122A-B, bushing 124A-B and slot 1I 5A-B arrangement previously discussed.

Figure 4:
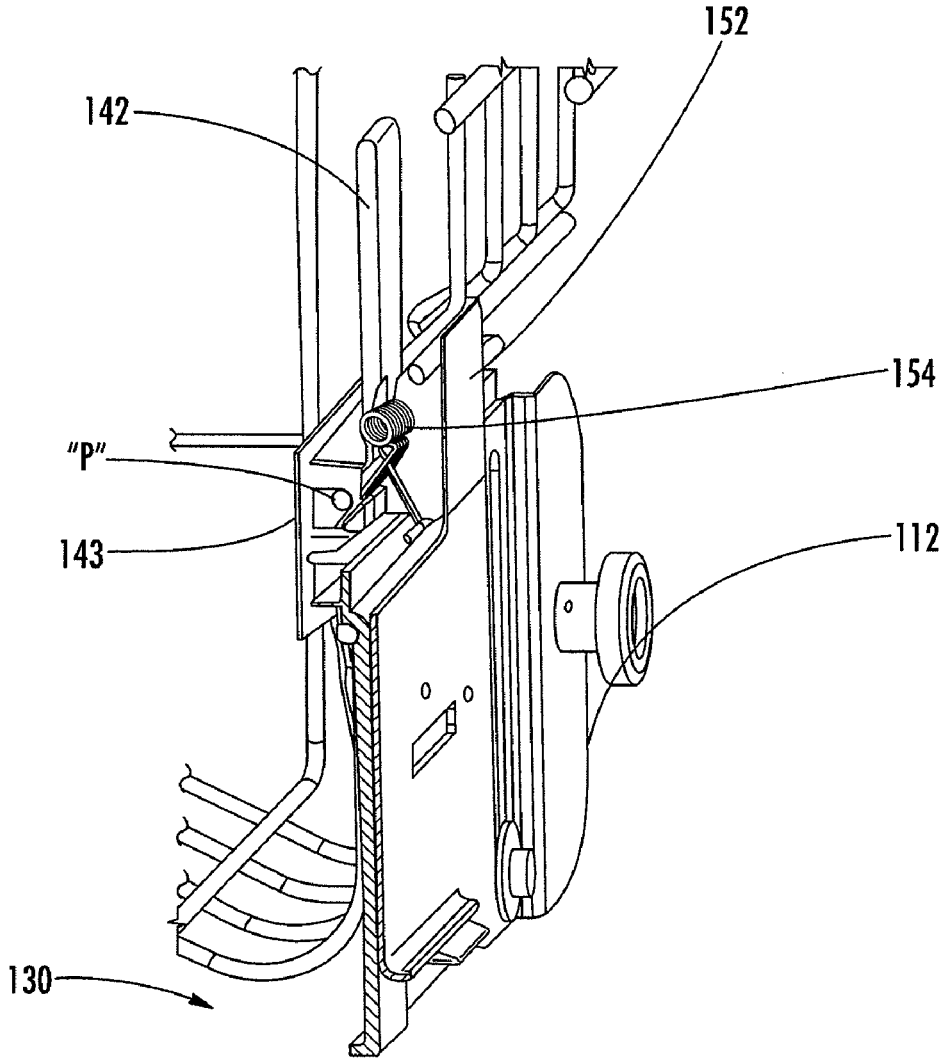
FIG. 4 is a section view of the embodiment of the present invention shown in FIG. 1 illustrating the relative positioning of a lever and spring.

FIG. 4 illustrates the interaction between the biasing assembly 150 and the lever 140. As illustrated, the biasing assembly 150 includes a housing 152 connected to the dish rack 105 and a biasing element 154. In the illustrated embodiment, the biasing element is a coil spring with cantilevered diverging tag ends (i.e., such as the spring used by a clothespin). The biasing element 154 biases the free ends 145A-B of the lever 140 toward the wheel mounting plate 112. A force may be applied to the handle portion of the lever causing the lever to pivot about pivot point "P" thereby counteracting the biasing force of the biasing element 154. This pivoting may disengage the free ends 145A-B from the locating edges 116,117 or the slots 118A-B as will be discussed in greater detail below.

Figure 5:
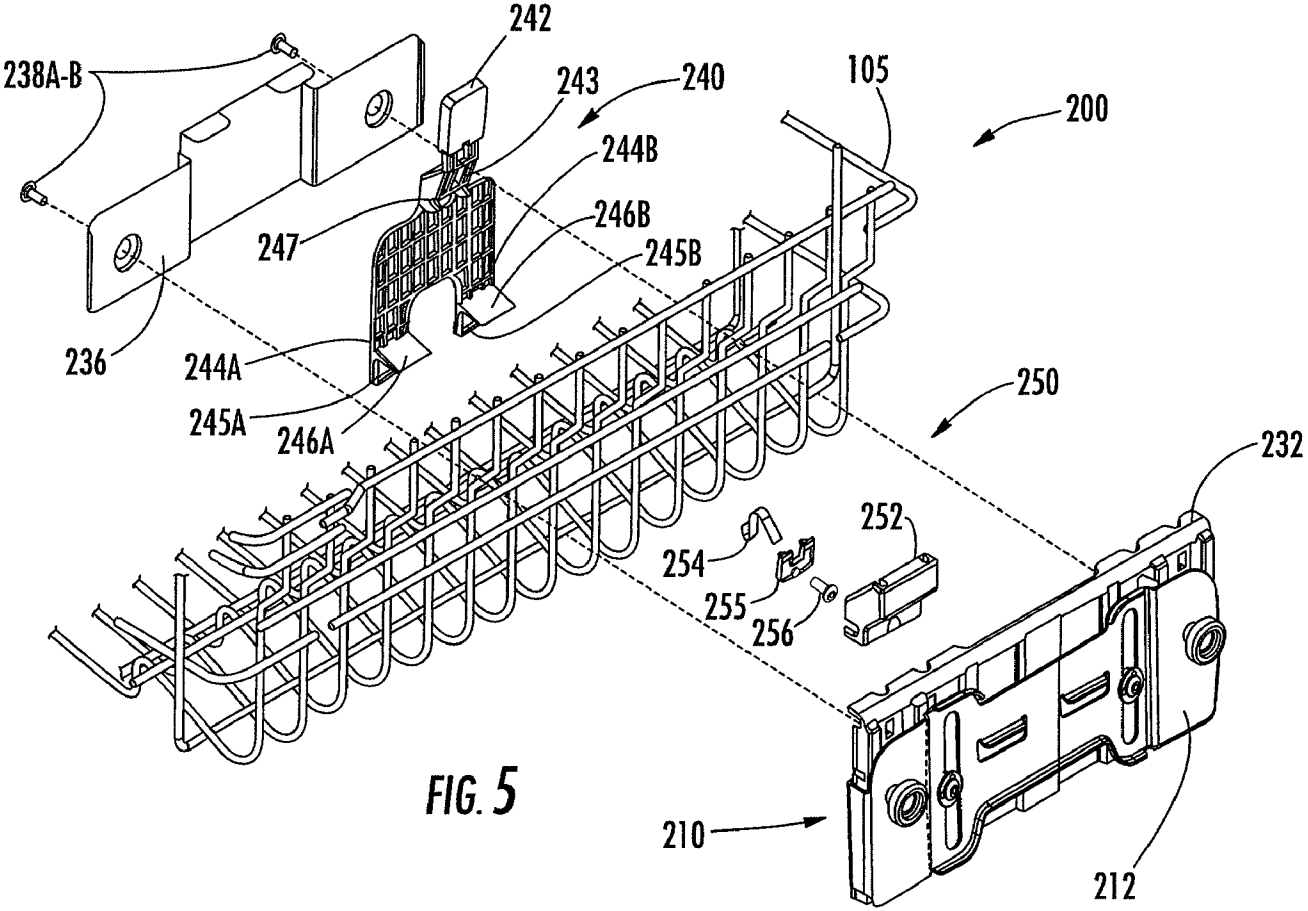
FIG. 5 is an exploded view of a height adjustment mechanism for a dishwasher rack according to an alternative embodiment of the present invention.
Figure 6:
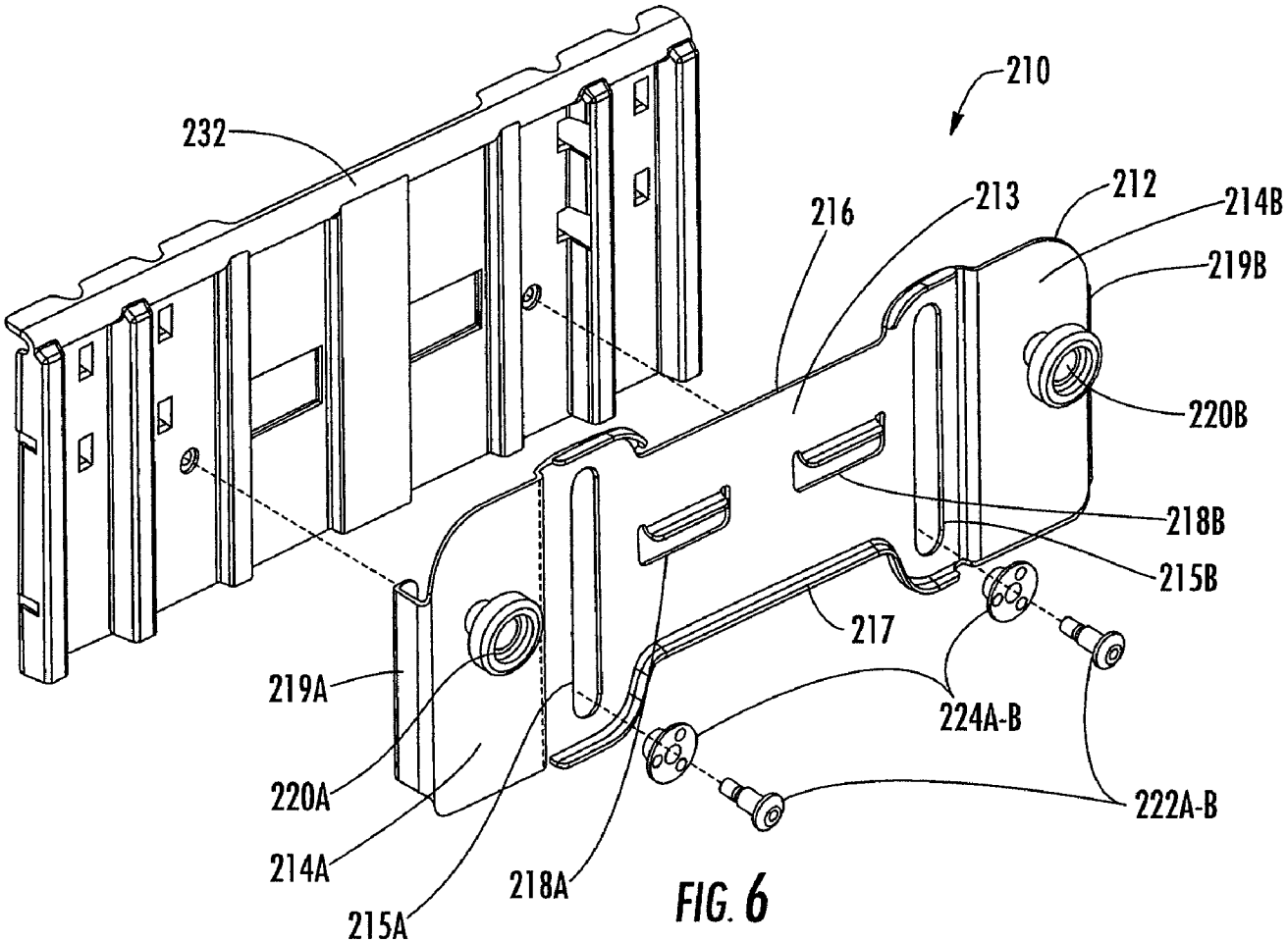
FIG. 6 is an exploded view of a portion of the embodiment shown in FIG. 5 illustrating an outside rack mounting plate and a wheel assembly.

FIGS. 5 and 6 illustrate an alternative embodiment of the height adjustment mechanism. This alternative embodiment is generally indicated as numeral 200. Similar to the embodiments described above, the height adjustment mechanism 200 includes a wheel assembly 210, a rack mount assembly comprising an outside rack mounting plate 232 and an inside rack mounting plate 236, and a lever assembly 240.

Referring to FIG. 6, the wheel assembly 210 includes a wheel mounting plate 212 and a pair of wheels 220A-B configured substantially the same as the wheel assembly 110 described above. The wheel mounting plate 212 includes a base portion 213 that defines two substantially parallel vertical slots 215A-B. These slots are sized to cooperate with pins 222A-B and bushings 224A-B to provide a slideable attachment between the wheel assembly 210 and the outside rack mounting plate 232. The wheel mounting plate 212 also includes two substantially planar flange portions 214A-B.

One distinction between the wheel mounting plate 212 and the wheel assembly 112 is that the wheel mounting plate 212 includes C-shaped features 219A-B extending from the planar flange portions 214A-B that open toward the center of the wheel mounting plate 212. These C-shaped features are configured to slideably engage the outside mounting plate 232 when in use. This feature provides additional stability to the dish rack by discouraging movement of the outside rack mounting plate 232 relative to the wheel mounting plate 212 in a direction other than parallel with the vertical slots 215A-B.

As with the height adjustment mechanism 100, the wheel mounting plate 212 of the height adjustment mechanism 200 includes features configured to be selectively engaged by the lever assembly 240. Specifically, the wheel mounting plate 212 defines two slots 218A-B that are spaced apart and oriented such that the longitudinal axes of the slots 218A-B are substantially aligned. The wheel mounting plate 212 further defines an upper locating edge 216 and a lower locating edge 217.

Turning to FIG. 5, the outside rack mounting plate 232 is positioned on the outside of the dish rack 105, while the inside rack mounting plate 236 is positioned inside the dish rack 105. These two mounting plates are secured together using fasteners 238A-B with the dish rack 105 therebetween. The embodiment illustrated in FIG. 5 does not include a rack engagement mechanism (e.g., 135) as describe above with reference to the height adjustment mechanism 100; however, one of ordinary skill in the art will recognize that a rack engagement mechanism 135 could be utilized in the height adjustment mechanism 200 if desired.

The lever 240 is similar to the previously described lever 140, in that it includes a handle portion 242, a biasing element interface portion 243 and two engagement arm portions 244A-B. The biasing element interface portion defines a recess 247, which is sized and shaped to receive a wire of the dish rack 105. In use, attachment bracket 255 and fastener 256 secure the wire of the dish rack 105 into the recess such that the lever 240 can pivot about the wire.

One distinction between the lever 240 and the lever 140 is that the engagement arm portions 244A-B of lever 240 are substantially planar as opposed to having an arcuate shape like the engagement arm portions 144A-B described above with reference to lever 140.

The engagement arm portions 244A-B include free ends 245A-B. These free ends include wedge portions 246A-B, which are generally the same shape as wedge portions 146A-B described with reference to the earlier embodiments.

The biasing assembly 250 includes a housing 252 and a biasing element 254. In the illustrated embodiment, the biasing element is a flat spring with one free end engaging the housing 252, which is attached to the dish rack 105. As one of ordinary skill in the art will recognize, the housing 252 may be attached to the dish rack through the use of C-shaped recesses formed in the housing that create a "snap" fit with portions of the wire rack or it could be attached using other known or developed fastening mechanisms. The other free end of the flat spring engages the biasing element interface portion 243 of the lever 240 such that the engagement arms 244A-B of the lever 240 are biased (or pivoted) toward the wheel mounting plate 212.

Methods of Use

In one embodiment of the present invention, an upper dish rack is attached to dishwasher using two adjustable height mechanisms 100—one on each side. The adjustable height mechanisms allow a user to select one of a plurality of possible upper rack heights. In one embodiment, a user can raise the height of upper rack from one of the lower positions by simply applying an upwardly directed force to the dish rack.

The inclined upper end of the wedge portions 146A-B of the free ends 145A-B cooperate with the inclined or accurate flanges of the lower locating edge 117 or the upper edges of the slots 118A-B such that the free ends 145A-B disengage the engagement features of the wheel mounting plate 112 without having to apply a force to handle portion 142 of the lever 140. To lower the rack, a user applies a force to the handle portion 142 of the lever 140 on the two adjustable height mechanisms, which disengages the horizontal lower ends of the wedge portions 146 from the engagement features, and then lowers the rack to the desired height. The embodiments illustrated in FIGS. 1-6 include three possible heights, but one of ordinary skill in the art will recognize that the wheel mounting plate 112 may include additional slots similar to slots 118A-B to facilitate additional height options. In one embodiment, the locating edges 116, 117 may be spaced apart by a distance, for example of about 3 inches, with the slots 118 A-B being disposed about half way therebetween. In such instances, the rack 105 may have about a 3 inch height adjustability range in increments of about 1.5 inches. However, one skilled in the art will appreciate that the actual height adjustability may vary considerably depending on the desired configuration of the dishwasher. For instance, the actual height adjustability may be greater than zero inches, up to about 6 inches or greater, as necessary or desirable.

Figure 7:
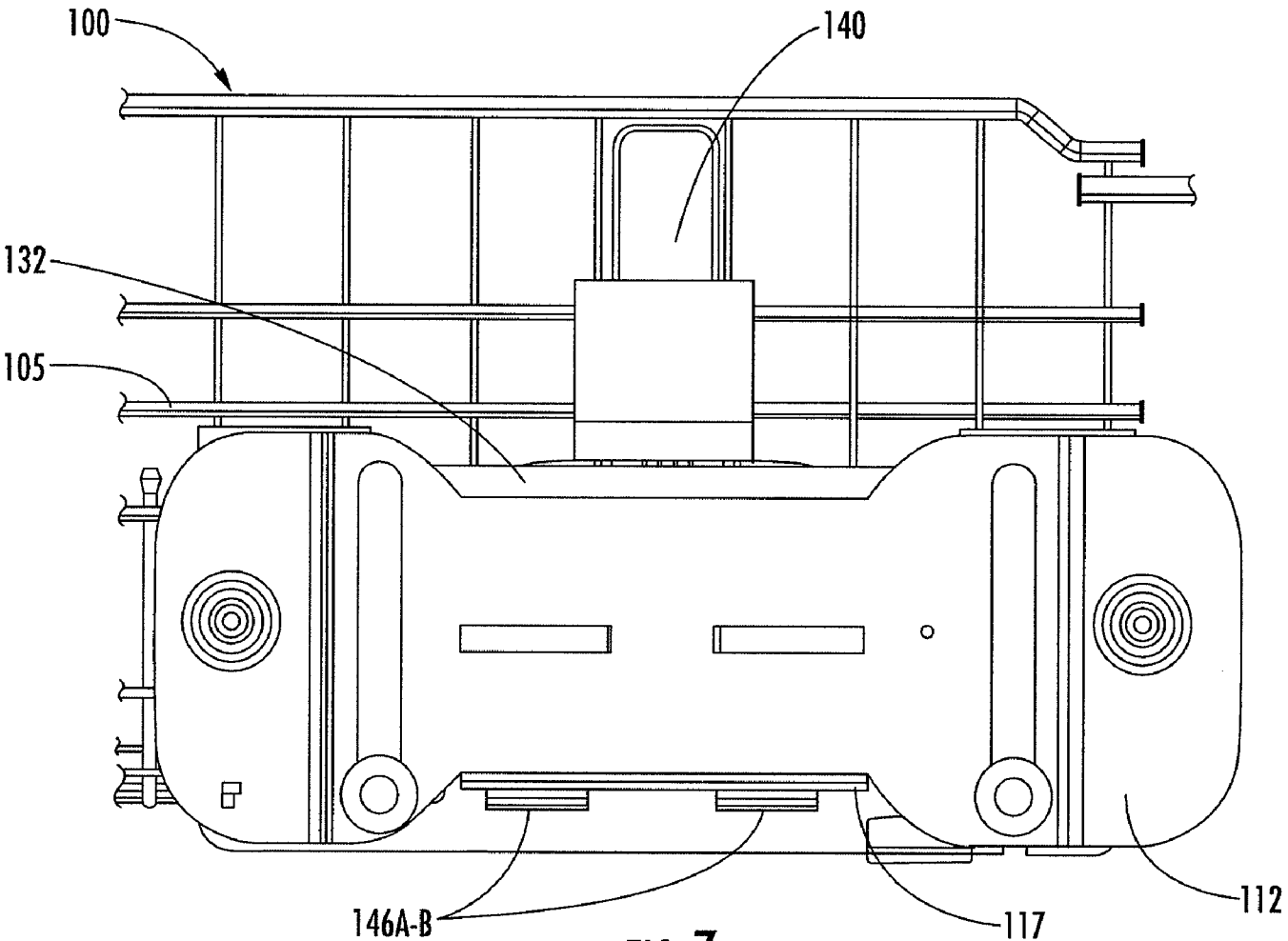
FIG. 7 is a front view illustrating the embodiment of the present invention shown in FIG. 1 with the rack at its lowest position.

FIG. 7 illustrates a height adjustment mechanism 100 at its lowest height position. At this position, the pins 122A-B engage the lower end of the slots 115A-B such that the rack mounting assembly and therefore the dish rack itself are supported by the pins 122A-B and the wheel mounting plate 112. The upper surfaces of the wedge portions 146A-B of the lever 140 engage the lower locating edge 117 of the wheel mounting plate 112.

To raise the dish rack from the lowest position as shown in FIG. 7, a user may apply an upwardly directed force to the rack 105 and/or the rack mounting assembly 130. As the rack mounting assembly 130 is raised, the geometry of the wedge portions 146A-B will create a force that counteracts the pivoting force created by the biasing element, thereby allowing the wedge portion to slide away from the lower locating edge 117. Once free of the lower locating edge 117, the wedge portions 146A-B will continue to be biased against the surface of the wheel mounting plate 112 by the biasing element 154 and will slide against this surface as the rack mounting assembly 130 rises.

Figure 8:
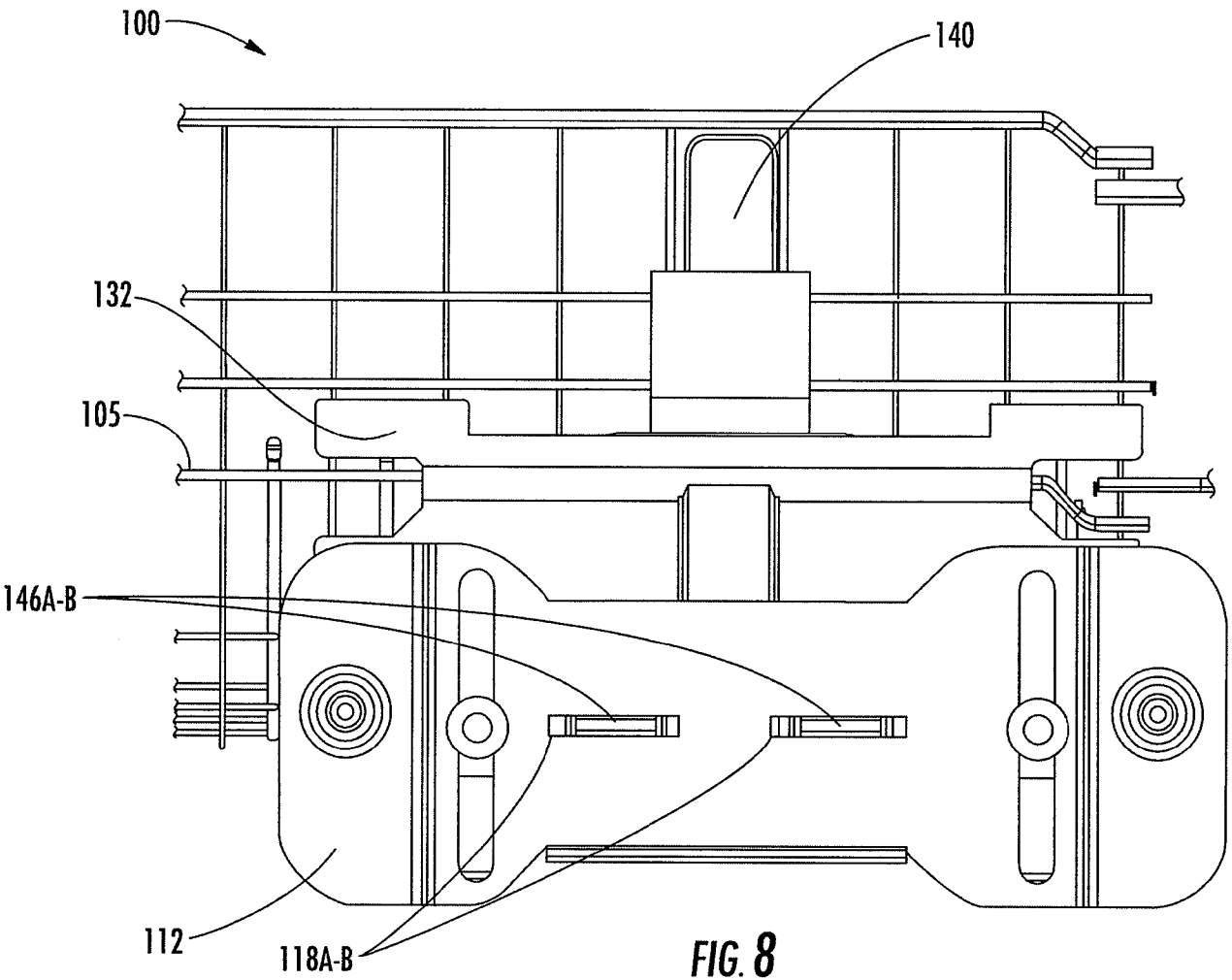
FIG. 8 is a front view illustrating the embodiment of the present invention shown in FIG. 1 with the rack at an intermediate position.

Upon reaching the intermediate height position as determined by the height of slots 118A-B, the wedge portions 146A-B engage the slots 118A-B with the horizontal stop members 148 engaging the inner surface of the wheel mounting plate 112. FIG. 8 illustrates the height adjustment mechanism 100 in an intermediate position. In this position, the rack mounting assembly and therefore the dish rack is supported by the engagement of the free ends 145A-B of the lever 140 with the wheel assembly 110.

Figure 9:
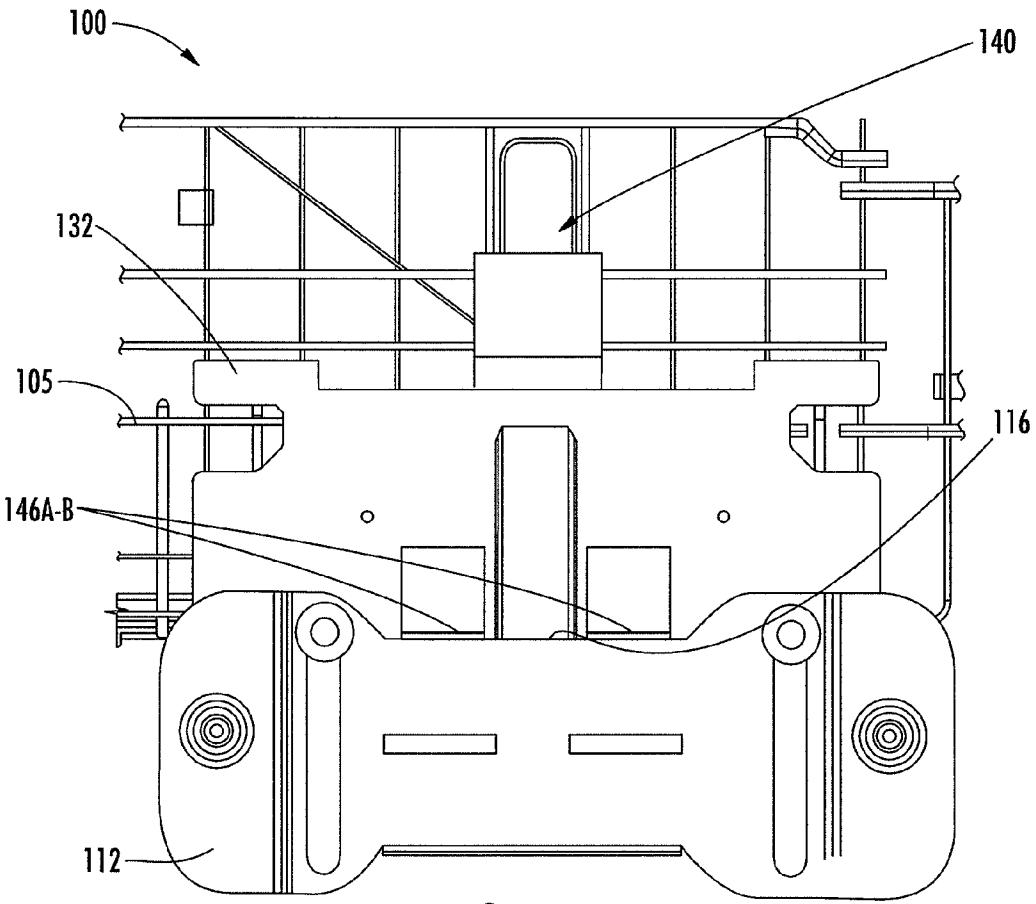
FIG. 9 is a front view illustrating the embodiment of the present invention shown in FIG. 1 with the rack at its highest position.

To raise the dish rack to its top position as shown in FIG. 9 from the intermediate position shown in FIG. 8, a user may apply an upwardly directed force to the rack 105 and/or the rack mounting assembly 130. As the rack mounting assembly 130 is raised, the geometry of the wedge portions 146A-B will create a force that counteracts the pivoting force created by the biasing element thereby allowing the wedge portions 146A-B to slide out of slots 118A-B. Once free of the slots 118A-B, the wedge portions 146A-B will be biased against the surface of the wheel mounting plate 112 and will slide against this surface as the rack mounting assembly 130 rises.

Upon reaching the top height position as determined by the upper locating edge 116, the wedge portions 146 engage the upper locating edge 116 with the horizontal stop members 148 engaging the inner surface of the wheel mounting plate 112. FIG. 9 illustrates the height adjustment mechanism 100 in a top height position. In this position, the rack mounting assembly 130 and therefore the dish rack 105 is supported by the engagement of the lever 140 with the upper locating edge 116 of the wheel mounting plate 112. In this embodiment, the rack mounting assembly 130 is prevented from traveling beyond a predetermined height by the interaction of the pins 122A-B and the top of slots 115A-B.

In an alternative embodiment, the user applies a force to the handle portion 142 of the lever 140 against the biasing element 154 to disengage the wedge portions 146A-B of the lever from the wheel mounting plate 112 and then raises the rack mounting assembly 130 and therefore the dish rack 105 to one of the plurality of height positions.

To lower the rack from either the top height position or the intermediate height position, a user applies a force to the handle portion 142 of the lever 140 as generally shown in FIG. 4. This force counteracts the force created by the biasing element 154 and causes the wedge portions 146A-B of the lever 140 to disengage the wheel mounting plate 112. The dish rack 105 can then be positioned in a different height position.

Many modifications and other embodiments of the inventions set forth herein will come to mind to one skilled in the art to which these inventions pertain having the benefit of the teachings presented in the foregoing descriptions and the associated drawings. For example, a single engagement arm may be employed or additional of slots may be defined by the wheel mounting plate. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A dishwasher having a first side wall and an opposing second side wall, said dishwasher comprising:

a dish rack adapted to support dishware in said dishwasher; and a first and a second height adjustment mechanism attached to said dish rack and slideably engaged with said first side wall and said second side wall, respectively, wherein said dish rack is supported by said first and said second adjustable height mechanisms such that said dish rack is moveable in elevation relative to said dishwasher, wherein each of said first and second height adjustment mechanisms comprises:

a wheel assembly adapted to be slideably engaged relative to the respective side wall and including a plurality of engagement features corresponding to a plurality of dish rack heights;

a rack mounting assembly attached to said dish rack and slideably engaged with said wheel assembly;

a lever pivotably engaged relative to said rack mounting assembly and configured to selectively engage one of said plurality of engagement features associated with said wheel assembly so as to secure said rack mounting assembly at a selected elevation relative to said wheel assembly; and a biasing element configured to urge said lever to pivot against said wheel assembly and into selective engagement with said plurality of engagement features.

2. The dishwasher of claim 1, wherein said lever includes a handle portion and a plurality of engagement portions and wherein each of said plurality of engagement portions includes a substantially wedge shaped portion configured to selectively engage said plurality of engagement features of said wheel assembly.

3. The dishwasher of claim 1, wherein said plurality of engagement features includes one or more slots defined by said wheel assembly.

4. The dishwasher of claim 3, wherein said plurality of engagement features includes a peripheral edge of said wheel assembly.

5. The dishwasher of claim 3, wherein said plurality of engagement features includes the lower peripheral edge of said wheel assembly.

6. The dishwasher of claim 1, wherein the distance between said first location and said second location is about 3 inches.

7. The dishwasher of claim 1, wherein said wheel assembly includes a C-shaped portion configured to slideably engage a portion of said rack assembly.

8. The dishwasher of claim 1, wherein said plurality of engagement features includes a first peripheral edge, a second peripheral edge and one or more intermediate slots.

9. The dishwasher of claim 1, wherein said wheel assembly defines two substantially parallel slots, wherein each slot is configured to cooperate with an associated pin attached to said rack assembly to facilitate slideable engagement between said wheel assembly and said rack assembly.

* * * * *